United States Patent [19]

Piccoli

[11] Patent Number: 5,003,135

[45] Date of Patent: Mar. 26, 1991

[54] CABLE-CONTROLLED ELECTRICAL SAFETY SWITCH DEVICE

[75] Inventor: Jean-Luc Piccoli, Angouleme, France

[73] Assignee: La Telemecanique Electrique, Nanterre, France

[21] Appl. No.: 326,504

[22] Filed: Mar. 20, 1989

[30] Foreign Application Priority Data

Mar. 25, 1988 [FR] France ..... 88 03960

[51] Int. Cl.[5] ..... H01H 3/02; H01H 17/02; F16P 3/00; G05G 1/02

[52] U.S. Cl. ..... 200/52 R; 200/543

[58] Field of Search ..... 200/17 R, 18, 52 R, 200/543, 31 R, 545, 286, 573, 574

[56] References Cited

U.S. PATENT DOCUMENTS

| | | | |
|---|---|---|---|
| 3,169,619 | 2/1965 | Alexander, Jr. et al. | 192/143 |
| 4,112,265 | 9/1978 | Crepeau et al. | 200/31 R |
| 4,458,122 | 7/1984 | Knight | 200/545 X |

FOREIGN PATENT DOCUMENTS

| | | |
|---|---|---|
| 2810745 | 6/1979 | Fed. Rep. of Germany . |
| 3508302 | 9/1986 | Fed. Rep. of Germany . |
| 1525342 | 4/1968 | France . |

*Primary Examiner*—J. R. Scott

*Attorney, Agent, or Firm*—Young & Thompson

[57] ABSTRACT

A cable-controlled electrical safety switch device comprises a piston 15 tensioning a cable 2 under the action of a spring 23 via a rod 10 and a screw thread 12*a* for adjusting the tension of the spring and of the cable. A piston groove 25 actuates a push member 28 for the switch 40. The piston is angularly adjustable. The flank 32 of the groove remote from the spring is helicoidal. When the cable is long, a higher tension is selected so that the groove flank 31 moves away from the push member 28. This distancing is desirable in order that any length variations due to heat—which are greater with a long cable—may be prevented from triggering the switch. The clearance between the other flank 32 and the push member 28 is then corrected by rotation of the piston.

10 Claims, 3 Drawing Sheets

CABLE-CONTROLLED ELECTRICAL SAFETY SWITCH DEVICE

FIELD OF THE INVENTION

This invention relates to a cable-controlled electrical safety switch device.

The invention relates more particularly to a cable-controlled electrical safety switch device, in which a movable assembly adapted to be connected to the cable and guided in a direction of movement with respect to a casing is subjected to the force of a cable-tensioning spring and has, on either side of an actuating member associated with an electrical switch, two flanks of a groove which actuate said member when the cable breaks and when the cable undergoes a transverse deflection respectively.

BACKGROUND OF THE INVENTION

Switch devices of this kind are intended more particularly to provide safety for personnel concerned with supervising, controlling or maintaining an installation extending over a considerable length along which the cable is tensioned. In the event of danger, the personnel apply a deflection to the cable to pull the movable assembly against the return force exerted by the spring. One of the groove flanks encounters the actuating member and this actuates the switch.

Amongst the malfunctioning to which devices of this kind may be subject we should first mention unintentional deflection to which the cable may be subjected when an operator comes into contact with it involuntarily. It is desirable that such involuntary deflection should not result in actuation of the switch. The same applies to quick deflections due to unauthorized use, to simulate a breakdown.

Another disorder to which such devices are subject is due to the elongation or shrinkage of the cable due to heat as a result of temperature variations in the cable environment. Variations of the order of 10° C. are in no way exceptional in any latitude, resulting in a steel cable 30 m long having length variations of the order of 3.5 mm.

It has also been found that inadequate tension of the cable allows very low frequency oscillations to develop, the amplitude of which may be sustained or increased in response to pulses due, for example, to the wind. When a certain amplitude is reached the result is abnormal actuation of the switches even in the absence of nearby staff.

The various factors which are likely to result in undesirable actuation of the switches therefore shows that the adjustment of such a device is relatively complex despite its apparent simplicity, and it is advisable to provide the installation engineer with adjustable such devices to allow for accommodation of the influence of the various parameters mentioned above.

OBJECT OF THE INVENTION

The object of the invention therefore is to provide a cablecontrolled electric safety switching device in which steps are taken to satisfy the above requirements.

SUMMARY OF THE INVENTION

According to the invention, the switch device is characterised in that the groove is disposed at the periphery of an adjustable element and has, in the direction of movement of the assembly, a dimension which varies along said periphery, the adjustable element being adapted to be oriented about its direction of movement so as to adjust the distance measured, along the direction of movement, between the actuating member and at least one of the flanks.

BRIEF DESCRIPTION OF THE DRAWINGS

The invention will be more readily understood from the following description and the accompanying drawings wherein.

DESCRIPTION OF THE PREFERRED EMBODIMENTS

A safety switch 1 controlled by a cable 2 visible in FIG. 1 comprises a body 3 made preferably of a pressure cast metal so that, on the one hand, two separate compartments 4, 5 may be readily formed in its interior, said compartments having separate functions which will be described in detail hereinafter, and, on the other hand, to give it sufficient rigidity in response to the forces which may be transmitted to it on deflection of the cable 2, particularly when it is very long.

Figure 2:
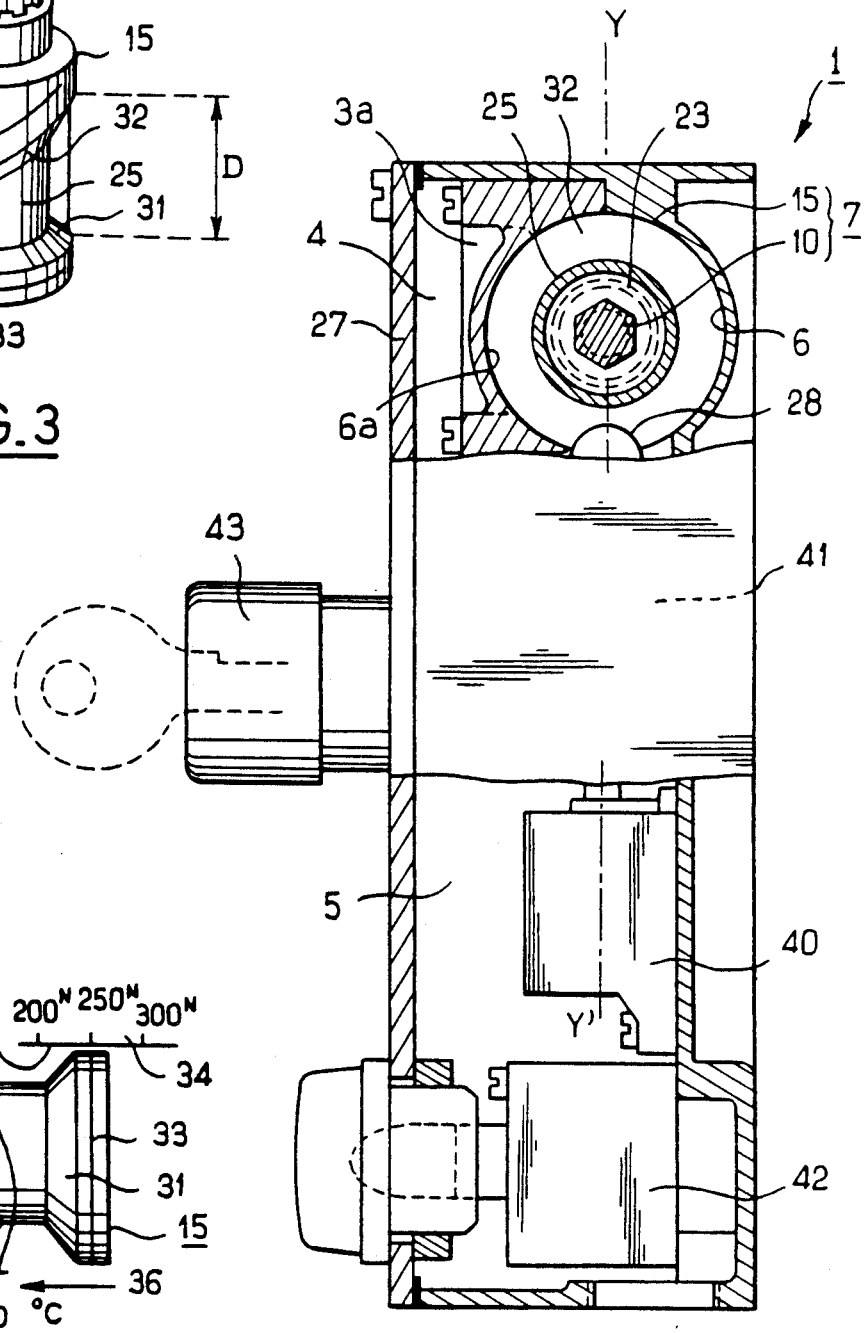
FIG. 2 is a side view in partial section along a plane containing the axis YY' and perpendicular to the axis XX'.
Figure 4:
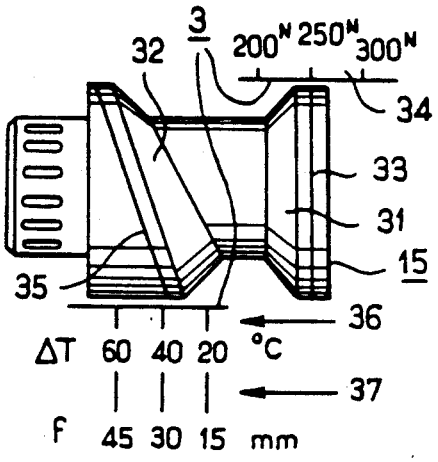
FIG. 4 is a detail in elevation of the control piston.

An inner surface 6 of the compartment 4 is elongated along an axis XX' and guides along said axis a piston 15 of a movable sliding assembly 7. Compartment 4 is closed laterally by a plate 3*a* (see FIG. 2) which is fixed to the body 3 and has a cylindrical surface 6*a* which completes the axial guidance of the piston 15, the outer side surface of which is of a generally cylindrical shape.

The movable sliding assembly 7 also comprises a rod 10 having a non-circular, e.g. hexagonal, sectional shape. An outer end 11 of rod 10, remote from the piston 15, is fixed adjustably by a screwthread 12*a* to a ring 12 receiving the end of the actuating cable 2.

Between its two ends the rod 10 is guided through a matching hexagonal aperture 13*a* in a bearing 13 fitted into an aperture 9 in the body 3. The bearing 13 also supports one of the ends of a deformable sealing bellows 14, the other end of which is fixed to the end of the ring 12.

The rod 10 has a collar 10*a* received in an axial inner recess 21 of the piston 15 and axially retained between a shoulder 20*a* and a retainer 20*b* so that the piston 15 is connected to the rod 10 in respect of axial displacement.

The end 16 of the rod has radial recesses in which springs 18 urge radially outwards balls 17 which are thus urged to engage in inner splines 19 of an axial bore 20 of the piston 15. This provides angular locking of the rod 10 relatively to the piston 15 while allowing orientation of the piston 15 with respect to the rod 10 about the axis XX' provided that sufficient force is transmitted to urge the balls 17 radially inwards against the springs 18.

The splined bore 20 is connected by the shoulder 20*a* to the end of the recess 21 remote from the ring 12.

The recess 21 receives the movable end 22 of a safety spring 23 operating in compression between the collar 10*a* and a fixed surface 24 such as the inner surface of the bearing 13.

Between two longitudinal ends of its outer side surface the piston has a peripheral recess or groove 25 having a trapezoidal sectional shape. The distance separating two opposite inclined flanks 31, 32, of groove 25, as measured parallel to the axis XX', increases progressively from one end to the other of the peripheral extent of the recess.

One of the flanks 31 of the recess is a conical surface while the other flank 32 is a surface of helicoidal type.

Figure 3:
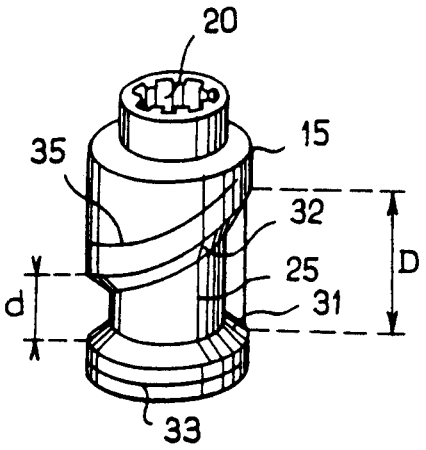
FIG. 3 is a perspective view of the control piston.

Thus as shown in FIG. 3 the said dimension progresses between a dimension—d—and a dimension—D—during a rotation of, for example, 180° about the piston axis. Thus by rotating the piston 15 about its axis XX' with respect to the rod 10 it is possible to vary the width of the recess 25 in front of an aperture 29*a* formed through a partition 29 between the compartments 4 and 5. To rotate the piston 15 a cover 27 (FIG. 2) is removed and access is available to the piston 15, with or without the use of a special tool, via an aperture or suitable recess in the plate 3*a*.

When the piston is in the inoperative state, while the cable 2 experiences an appropriate initial tension from the spring 23, a rounded push member 28 extending through the aperture 29*a* is engaged in the recess 25. The tension is provided by giving the cable an appropriate length or by adjusting the position of the ring 12 on the rod 10 by means of the screwthread 12*a*.

In the event of breakage of the cable, the spring 23 urges the piston in the direction G, and this movement is converted into a movement of direction J of the push member 28 when the latter is pushed by the flank 31 of the recess 25.

If, on the other hand, the cable 2 experiences deflection due, for example, to a person in danger actuating it, the piston 15 moves in the direction F and the flank 32 of the recess 25 acts on the push member to transmit thereto a movement in direction J.

Depending upon whether the distance between the flank 32 and push member 28 is larger or smaller, the cable must be given a varying deflection to produce a movement of the push member in the direction J.

The construction of the piston 15 enables the apparatus to be adjusted to various cable parameters. Depending on the length of the cable, the initial tension will have to be increased or reduced. This operation is carried out in the inoperative state by adjusting the length of the cable, which causes a reference, such as a circular index line 33 on the side surface along the conical flank 31 of the groove 25, to come into register with an axial graduation 34 which may be carried either by the body of the device or by the guide plate. The position of the line 33 with respect to the graduation 34 is indicative of the state of compression of the spring 23, which provides tension of the cable 2.

The graduation 34 is, for example, in Newtons, or alternatively in metres of cable length if each cable length has a corresponding predetermined optimal tension.

The cable is also subject to unintentional lengthening or shortening due to heat. It is important that such phenomena should not cause actuation of the push member 28. To this end, the side surface of the piston has a second temperature index line 35 which follows a substantially helicoidal curve along the flank 32 of the recess 25.

When the piston 15 is rotated with respect to the rod 10, the line 35 moves with respect to a second fixed graduation 36, 37, which may be a graduation in temperature intervals, or in deflections to give a cable of specific length to result in actuation of the push member. The reading allowed in this way is a measurement of the distance between the push member 28 and the flank 32 and hence measurement of the shortening that the cable 2 can experience without actuating the push member 28.

The graduation could alternatively be measured in degrees C. m, in other words in temperature intervals multiplied by metres of cable length. A distance between the flanks and the push member 28 allowing a temperature interval of 40° C. for 10 m of cable allows only an interval of 20° C. for 20 m of cable, for example. The second graduation 36 or 37 may also be carried by the body of the device or by the guide plate.

For example, for a given angular position of the piston 15, if the latter is adjusted axially in the direction of increasing the tension of the cable 2, the flank 32 moves towards the push member 28 and the temperature drop admissible without the push member 28 being actuated drops. However, this axial movement of the piston 15 results in a displacement of the line 35 with respect to the scale 36, such displacement taking into account the said reduction in the admissible temperature variation. The operator is therefore quite naturally induced then to adjust the piston 15 angularly to return the admissible temperature variation to its initial value.

The compartment 5 receives a system of switches 40, an intermediate transmission device 41, and a display means 42. The transmission device 41, examples of which are given in copending French patent application 88 03 961 to the same applicant and inventor, and enjoying the same priority date, is adapted to ensure that any quick unauthorized actuation of the switches 40*a* and 40*b* causes a specific condition which is then retained by the switches. More particularly, the transmission device 41 transmits the movements of the push member 28 to a yoke 52 which simultaneously actuates the two switches 40*a* and 40*b* irreversibly, even if the piston 15 has remained only a very short time in the position for actuation of the push member 28. Resetting of the device to enable the push member 28 and the switches 40*a* and 40*b* to return to the inoperative position requires the action of an authorized person on a lock 43 provided with a key.

Thus to adjust the device, the primary element to be taken into account is the properties of the cable, i.e. its length and its linear density; these two parameters allow the tension which is to be transmitted to it to be determined by adjusting its length either by means of a clamp or a tensioner, or by means of the ring 12, to bring the first index 33 into register with the corresponding graduation of the scale 34.

The piston 15 is then rotated until the second index 35 registers with the selected graduation on the second scale 36 which gives the temperature intervals which must not be exceeded when the adjustment operation is, for example, carried out at an ambient temperature of 15° C. Since a relatively high tension, and hence a relatively large distance between the flank 31 and the push member 28, is selected, on the one hand, for a relatively long cable while on the other hand the distance selected between the flank 32 and the push member 28 is substantially proportional to the cable length in the case of any given possible temperature interval, once the push member 28 is set it will be substantially in the middle of the groove 25 in most cases. The adjustment of the distance between the flank 31 and the push member 28 with respect to any thermal expansion of the cable is of course dependent upon the cable tension adjustment and may therefore be inaccurate in certain cases. However, the flank 31 is the one having the function of actuating the push member 28 in the event of cable breakage. It is therefore not particularly inconvenient to construct the device in such a manner that the distance between the flank 31 and the push member 28 is relatively large and the piston stroke is even larger in the event of cable breakage so that actuation of the push member takes place despite the magnitude of such distance.

Moreover, the distance between the flank 32 and the push member 28 as set for a maximum proposed temperature interval may be greater than the variation in length that the cable would experience in the event of such temperature variation taking place, so that when the temperature reaches the intended limit the piston can again perform a supplementary stroke without actuating the switch, e.g. in response to an unintentional action on the cable such as an action due to wind, an involuntary movement by an operator, and so on.

In the embodiment shown in FIG. 5, which will be described only in respect of its differences from FIGS. 1 to 4, the variable-width groove 25 of the rotary piston 15 with respect to the rod 10 has opposite flanks 31, 32 whose width progresses between a minimum value and a maximum value as a result of a helicoidal inclination which is substantially symmetrical with respect to a central plane PP' containing the push member 28.

Figure 5:
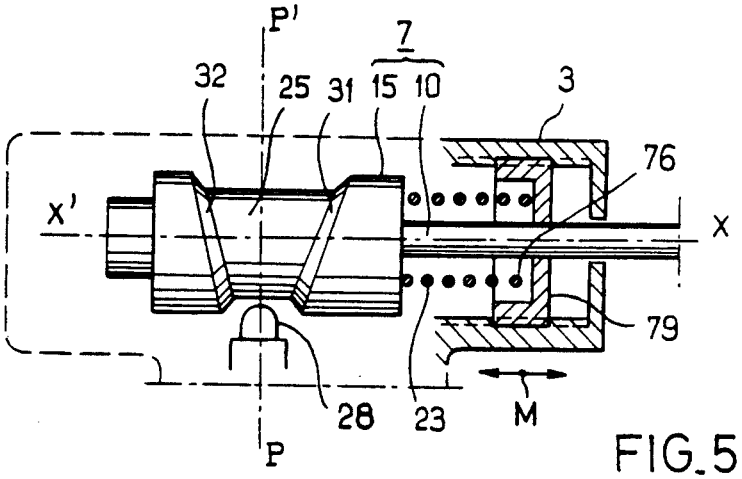
FIGS. 5 to 7 are diagrammatic views of three modified embodiments.

In this embodiment, the compression spring 23 bears, at its end 76 remote from the piston 25, against an internal screwthreaded member 79 adjustable axially in the body 3 along the axis XX' as shown by the two-headed arrow M in FIG. 5, in order to give the cable the required tension while retaining the push member 28 in a substantially central position between the two flanks 31 and 32.

Figure 6:
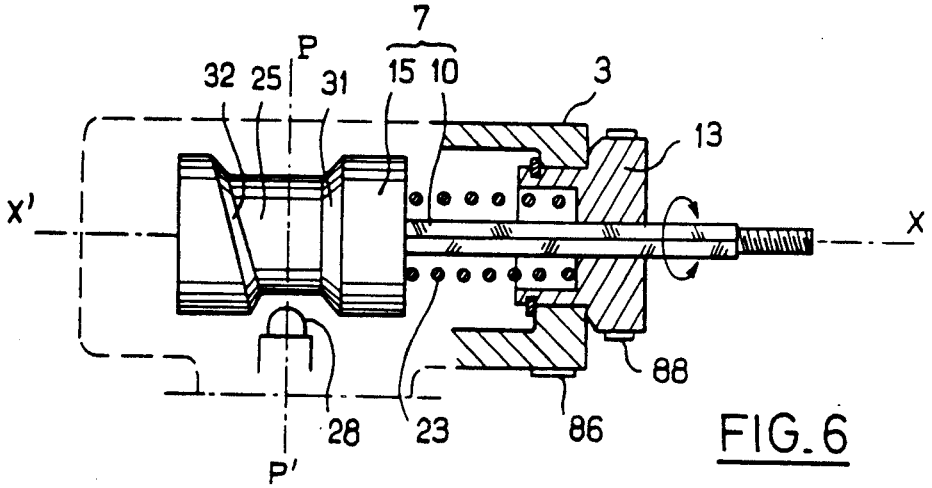

In the embodiment shown in FIG. 6, the rod 10 and the piston 15 of the movable assembly 17 are axially and angularly connected to one another; the bearing 13 which can be angularly oriented about the axis XX' in the body 3 has a temperature scale 88 moving with respect to an index 86 carried by the body 3. Angular adjustment of the bearing 13 resulting in adjustment of the rod 10 and the piston 15 can be carried out from outside the body 3 as can the reading of the index 86. The flanks 31, 32 of the groove 25 move apart asymmetrically with respect to the central plane PP' containing the push member 28, bearing in mind that, as in the embodiment shown in FIGS. 1 to 4, adjustment of the compression of the spring 23 is obtained by adjusting the cable length while the spring bears on an axially fixed member, e.g. the bearing 13.

Figure 7:
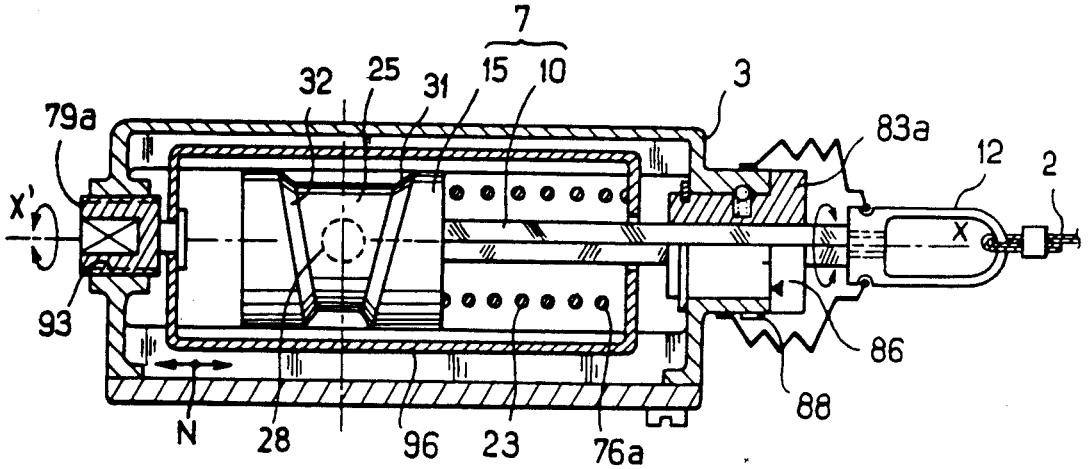

In the embodiment shown in FIG. 7, rotation of the bearing **83*a* in the body 3 allows angular adjustment of the piston as in the embodiment of FIG. 6. Adjustment of the compression of the spring 23 is carried out by means of a screwthreaded plug 79*a* which is fitted from outside into a tapped aperture 93 in the casing 3 remote from the rod and transmitting an axial movement to the end 76*a* of the spring 23, as shown by the two-headed arrow N, by means of a yoke 96** forming part of a movable assembly.

In this embodiment, there is therefore no need to open the cover to carry out the tension and temperature adjustments. The components to be actuated for these adjustments are both accessible from outside.

Figure 1:
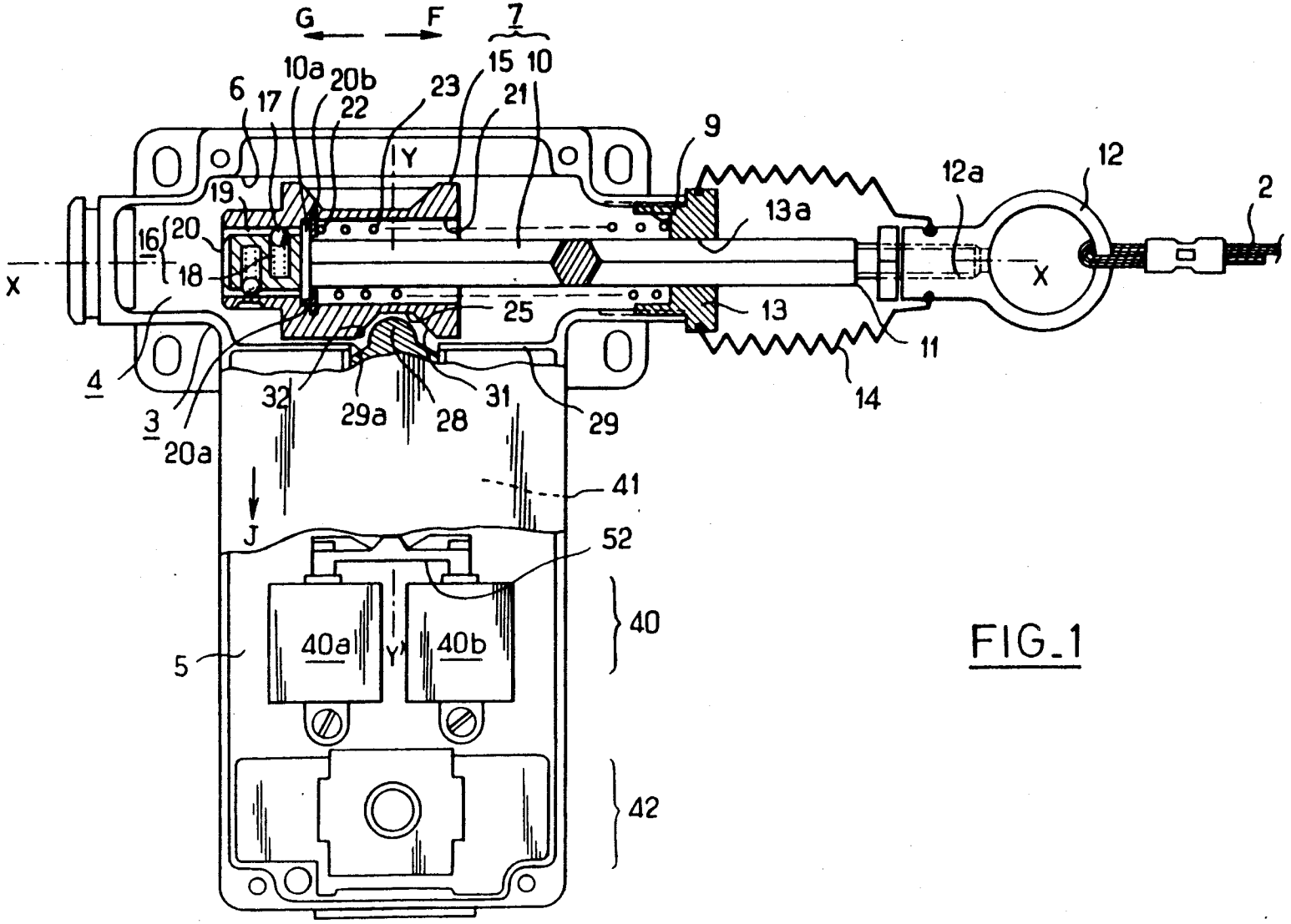
FIG. 1 is an elevation of the device according to the invention in section along a plane containing the axis XX' of a movable control piston and the axis YY' of an actuating push member.

In the embodiments shown in FIGS. 1 and 6, the flank 31 could have a slight helicoidal slope opposed to that of the flank 32 and less than that of the flank 32 so that for a given adjustment of the spring compression the rotation of the piston results in a variation of the distance between the flank 31 and the push member 28.

In the embodiment shown in FIG. 6, the bearing 13 could be screwed adjustably into the body. The number of turns of the bearing 13 then correspond to the adjustment of the spring while the last fraction of a turn angularly adjusts the piston. The rod 10 is coupled to the cable by a device of the swivel hook type which allows a relative rotation of several turns.

I claim:

1. A cable-controlled electrical safety switch device, comprising a casing;

a movably assembly disposed within said casing and having a portion adapted to be connected to a cable, said movable assembly being mounted for movement within said casing in a first direction and a second direction opposite said first direction, said movable assembly comprising a spring supported within said casing and resisting movement of said movable assembly in said first direction, said movable assembly further comprising a rotatable cam element having a periphery defining a groove formed between two cam flanks, said groove having a varying width extending parallel to said first direction of movement;

a switch actuating member mounted in said casing for movement along a third direction of movement transverse to said first and second directions, said switch-actuating member having a portion projecting into said groove, and means for selectively rotating said cam element about said first direction of movement so as to adjust a distance, as measured parallel to the first direction of movement, between the projecting portion of the actuating member and at least one of the cam-flanks, wherein said actuating member is actuated by a first said cam-flank when the movable assembly is displaced by the spring along the second direction of movement and said actuating member is actuated by a second said cam-flank when the movable assembly is displaced along the first direction of movement against the force of the spring.

2. A switch device according to claim 1, wherein the movable assembly comprises a tension rod non-rotatably mounted for sliding movement within the casing in said first and second directions, and the cam element is axially connected to said tension rod for rotation relative thereto against the action of releasable locking means comprised by the selective rotating means and disposed between the cam element and said tension rod, said locking means releasably maintaining a selected angular position between said cam element and said tension rod.

3. A switch device according to claim 1, further comprising marking means on at least one of the cam element and the casing for indicating the position of the movable assembly relative to the casing along said first direction of movement.

4. A switch device according to claim 3, wherein said marking means comprise an index formed on the cam element in a circumferential direction thereof, said index facing a graduation disposed on the casing transversely of the index.

5. A switch device according to claim 1, wherein the two cam-flanks are bevelled flanks, one of said two cam flanks being conical and the other of said two cam flanks being helicoidal.

6. A switch device according to claim 1, wherein said movable assembly comprises a rod to which said cam element is connected for conjoint rotation about and conjoint translation along said first and second directions of movement and wherein said rod extends slidably and non-rotatably through a bearing rotatably mounted in said casing, thereby to permit angular adjustment of said cam element with respect to the casing by rotation of said bearing relative to the casing.

7. A switch device according to claim 6, wherein the bearing has an exposed end portion which is accessible from outside the casing and has an index or graduation providing, with respect to a graduation or an index on the casing, an indication related to said distance between the projecting portion of the switch-actuating member and at least one of the cam flanks.

8. A switch device according to claim 1, wherein the spring bears at one end on the movable assembly and at the other end on an adjustable internal element mounted in the casing for selective displacement to, and non-translational fixing at, each of a plurality of positions along said first and second directions, said cam flanks diverging along the periphery of the cam element on either side of a plane transverse to said first and second directions of movement.

9. A switch according to claim 8, wherein the adjustable internal element has a portion extending outside the casing for adjustment of the position of the internal element from outside the casing.

10. A switch device according to claim 1, further comprising an oblique index formed on the periphery of said cam-element facing a graduation disposed on the casing transversely of the index, a position of the index along the graduation indicating a distance between the projecting portion of the actuating member and at least one of the cam-flanks.

* * * * *